United States Patent [19]

Braly

[11] 4,122,593

[45] Oct. 31, 1978

[54] METHOD OF MAKING GOLF CLUB SHAFTS

[75] Inventor: Joseph M. Braly, Kennett Square, Pa.

[73] Assignee: Con-Sole Golf Corporation, Kennett Square, Pa.

[21] Appl. No.: 796,080

[22] Filed: May 12, 1977

[51] Int. Cl.[2] ..... B23Q 17/00; A63B 69/36

[52] U.S. Cl. ..... 29/407; 29/558; 273/77 A

[58] Field of Search ..... 29/557, 558, 407; 273/77 R, 77 A; 73/65

[56] References Cited

U.S. PATENT DOCUMENTS

| | | | |
|---|---|---|---|
| 2,349,736 | 5/1944 | Knobel et al. | 273/77 A |
| 3,395,571 | 8/1968 | Murdoch | 273/77 A X |
| 3,871,649 | 3/1975 | Kilshaw | 273/77 A |
| 3,963,236 | 6/1976 | Mann | 29/557 X |

*Primary Examiner*—Victor A. DiPalma

*Attorney, Agent, or Firm*—Connolly and Hutz

[57] ABSTRACT

Method of producing variety of golf club shafts from universal blank shaft of given length includes steps of determining actual natural frequency of blank shaft. Selected amounts of shaft length are then removed from both tip and butt end portions of blank in correlation with natural frequency of blank. Total amount removed from blank solely depends upon length of shaft desired while selected amounts removed from tip and butt end portions of blank solely depend upon natural frequency of shaft desired. As proportional amount removed from tip portion increases, frequency of produced shaft also increases. Conversely, as proportional amount removed from tip portion decreases, frequency of produced shaft also decreases.

7 Claims, 2 Drawing Figures

METHOD OF MAKING GOLF CLUB SHAFTS

CROSS REFERENCE TO RELATED APPLICATION

This present application relates to my copending application Ser. No. 676,905 filed Apr. 14, 1976, and the disclosure thereof is incorporated by reference in the present application.

BACKGROUND OF THE INVENTION

The present invention relates to golf club shafts, and more particularly to the production of a variety of golf club shafts of varying natural frequency and length from a universal blank shaft of given length.

As presently manufactured, golf club sets are matched by utilizing static determinations including the originator's designation of shaft flex. The flex of a shaft is an arbitrary and relative designation and varies widely within specific flex designations. Generally, flex designation "X" stands for an extra stiff shaft, "S" for a stiff shaft, "R" for a regular shaft, "A" for a semi-flexible shaft, and "L" for a lady or flexible shaft.

Many flex designations are determined by utilizing a flex board which statically measures the deflection of a shaft under the influence of a predetermined test weight secured to the tip end of a shaft anchored at the butt end. In actuality this procedure does not measure the flex or elasticity of the shaft which varies according to cross-section, heat treating processes, metal composition and other such factors. Hence, deflection is the only shaft characteristic measured by this procedure.

The flexibility of a golf club shaft plays an important role in producing desirable golf shots. In connection with this role, it is believed highly desirable that during a golf shot the club shaft travel through a specific number of cycles of deflection from the start of the down swing of the club to its point of impact with the ball. Ultimately, when the club head contacts the ball, it is desirable that the shaft be in an undeflected position which locates the head at its point of maximum velocity.

Strain gage information, however, reveals that it is not possible to strike the ball in the acceleration phase of the golf club head. On a full shot with wood or iron, the ball is impacted during the deceleration phase. The objective, therefore, is to strike the ball as high in the deceleration phase, or as close to maximum velocity of the head as possible. Thus the timing or tempo of the swing must accommodate for the frequency or stiffness of the shaft.

The magnitude of the problem becomes evident when the golfer attempts to use the same swing, tempo, or timing with different golf clubs in a set that is mismatched in frequency or stiffness.

The above considerations clearly show the desirability of a frequency matched set of golf clubs. Utilizing such a set of clubs tailored to the swing of a particular golfer, when the proper pass is placed on each of these clubs, the club head contacts the ball closer to its point of maximum velocity thereby producing a highly desirable golf shot.

Heretofore the inventory of golf club shafts in the manufacture of club sets was quite substantial. Within each of the five categories of flex noted above, nine shaft lengths are required for the irons numbering two through nine and pitching wedge. This ultimately requires an inventory of 45 different shafts. Additionally, for reasons noted above, within each flex category the actual natural frequency of the particular shafts grouped therein greatly varies. Such variations of natural frequency within which each flex category significantly complicate the inventory of shafts necessary to produce frequency matched club sets.

SUMMARY OF THE INVENTION

Accordingly an object of the present invention is to produce golf club shafts of predetermined length and desired frequency from a universal blank shaft of given length having a natural frequency within a specified range.

In accordance with the present invention, a method is provided for producing a variety of golf club shafts of varying natural frequency and length from a universal blank shaft of given length. The universal blank shaft has tip and butt end portions and a natural frequency within a specified range. The method of the invention includes the steps of determining the actual natural frequency of the blank shaft, and after such determination is made, selected amounts of the shaft length are removed from both the tip and butt end portions of the blank in correlation with the actual natural frequency of the blank. The total amount removed from the blank solely depends on the length of the shaft desired. On the other hand the selected amounts removed from the tip and butt end portions of the blank solely depend upon the natural frequency of the shaft desired. Assuming a greater proportional amount is removed from the butt end portion compared to the amount removed from the tip end portion, the resultant shaft would be more flexible than a shaft produced by removing a proportionately greater amount from the tip end portion.

The series or variety of golf club shafts produced from a universal blank shaft of given length may include the shafts for the irons numbering two through nine and pitching wedge. Golf club shafts for the woods may also be produced utilizing the method of the present invention.

The step of determining the actual natural frequency of the blank shaft may include securing the butt end portion thereof in place at a stationary location. Next, a predetermined test weight is fastened at the tip end portion of the blank shaft and the shaft is excited. The frequency of the oscillations produced by the shaft are then measured to determine the natural frequency.

BRIEF DESCRIPTION OF THE DRAWING

Novel features and advantages of the present invention in addition to those described above will be apparent to those skilled in the art from a reading of the following detailed description of the drawing in conjunction with the accompanying drawing wherein similar reference characters refer to similar parts and in which.

DETAILED DESCRIPTION OF THE INVENTION

The present invention concerns a method of producing golf club shafts of varying natural frequency and length. Such production is accomplished by utilizing one or several universal blank shafts from which an infinite variety of individual shafts are made. While several groups of universal blank shafts may be used to produce the individual golf club shafts desired, the present discussion will be limited to a single group of universal blank shafts each having the same length and a natural frequency within a specified range. One or more other groups of universal blank shafts merely expand upon the invention to the extent that an even wider variety of golf club shafts may be produced.

Figure 2:
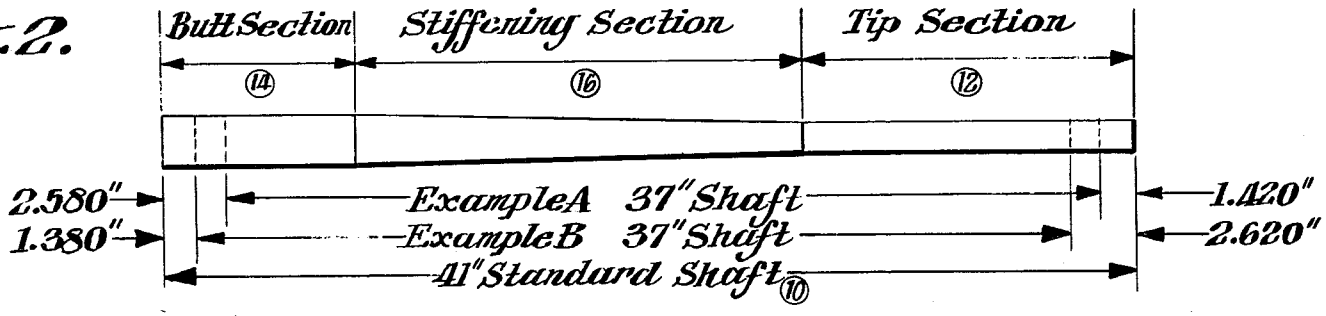
FIG. 2 is a diagram illustrating several random examples utilizing the chart of FIG. 1.

FIG. 2 of the drawing diagrammatically illustrates one of many universal blank shafts 10, each having an overall length of 41". Each blank shaft 10 has a tip end portion 12 and a butt end portion 14. These end portions are integrally connected with a central stiffening section 16. As diagrammatically shown in FIG. 2, the tip and butt end portions are cylindrical in shape while the stiffening section is tapered. Such tapered stiffening section may be a smooth taper, as shown in FIG. 2, or alternatively the tapered stiffening section may be provided by a series of stepped portions of decreasing diameter from the butt end to the tip end thereof.

The initial step in producing a desired golf club shaft involves the determination of the actual natural frequency of the universal blank shaft from which the desired club shaft is to be made. The actual natural frequency of the blank shaft may be determined by initially securing the butt end portion 14 in place at a stationary location. After fastening a test weight at the tip end portion 12, the blank shaft is excited and the frequency of the oscillations produced thereby are measured. Once the natural frequency of the blank shaft is determined, selected amounts of the shaft length are removed from both the tip and butt end portions of the blank in correlation with the actual natural frequency of the blank. The total amount removed from the blank solely depends upon the length of the shaft desired while the selected amounts removed from the tip and butt end portions solely depends upon the desired natural frequency of the shaft being produced.

For example, in the production of a standard six iron shaft, 37" of shaft length is required. Assuming a standard universal blank shaft of 41" in length, it is then necessary to remove 4" from the blank shaft. The selected amounts removed from the tip and butt end portions are determined on the basis of the desired natural frequency of the six iron shaft being produced. If a shaft of relatively higher frequency is desired, more of the 4" is removed from the tip end portion of the blank in comparison to the selected amount removed from the butt end portion of the blank. On the other hand, if a more flexible six iron shaft is desired, more length is removed from the butt end portion of the blank in comparison to the length of the blank shaft removed from the tip end portion.

Figure 1:
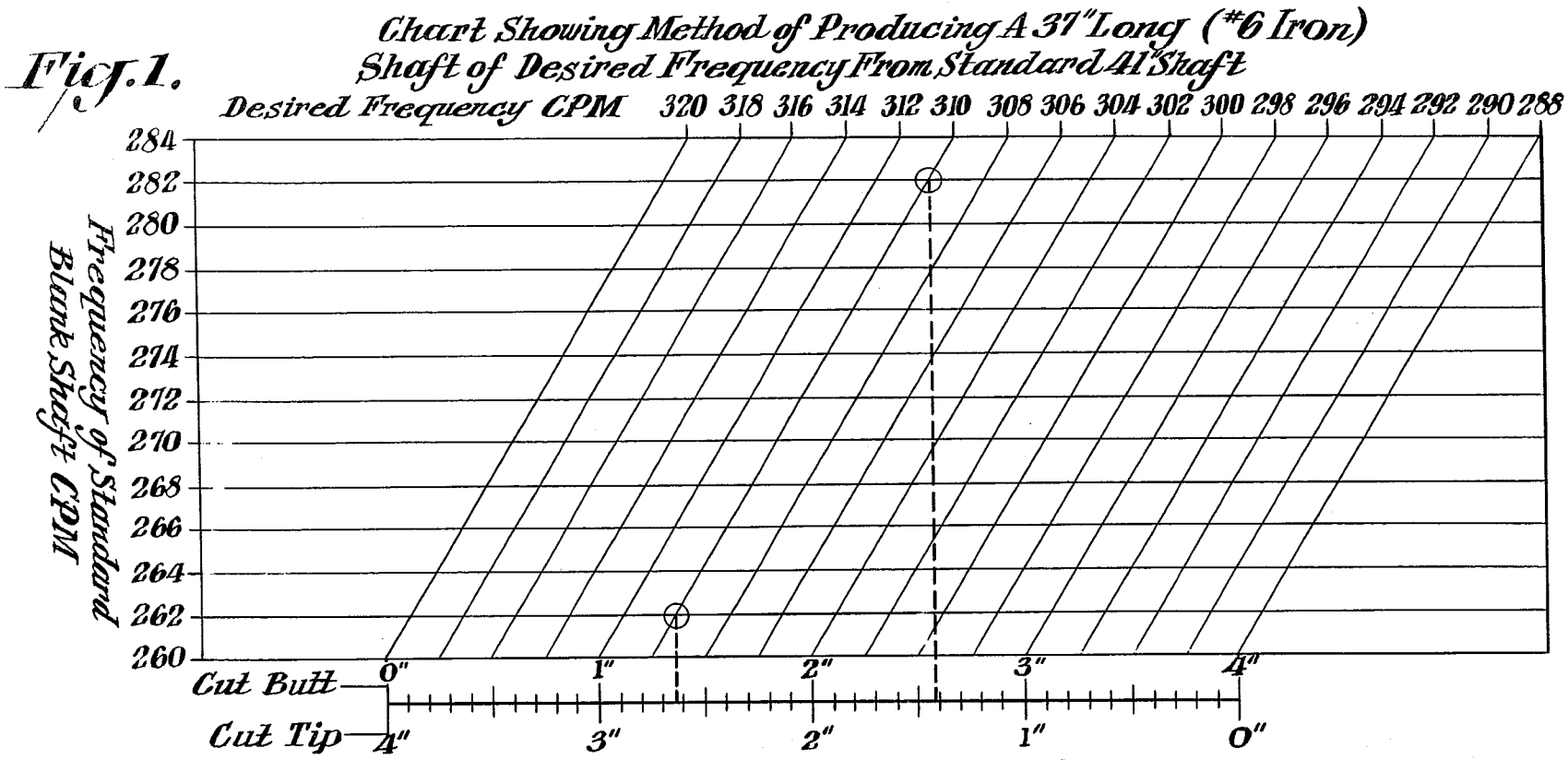
FIG. 1 is a chart showing the method of producing a 37" long golf club shaft of desired frequency from a universal standard 41" blank shaft.

FIGS. 1 and 2 diagrammatically illustrate the production of several 37" long six iron shafts. Each shaft is made from a universal blank shaft 41" in length, and the natural frequency of each blank shaft falls within a specified range. The desired natural frequency or flex of the shaft of Example A is 310 cycles per minute, as measured with a test weight of about 285 grams fastened to the tip end thereof. The universal blank shaft has a natural frequency of 282 cycles per minute, as measured with the same test weight, which necessitates removal of 2.58" from the butt end portion of the blank and 1.42" from the tip end portion of the blank, as shown in FIG. 1. If a slightly more flexible six iron shaft was desired, slightly more material would be removed from the butt end and slightly less material removed from the tip end, as is clear from the chart.

Shaft Example B also has a natural frequency of 310 cycles per minute when measured with the same test weight but in this case the universal blank shaft from which it is produced has a natural frequency of 262 cycles per minute using the same test weight. The selected amounts removed from the tip and butt end portions of the 262 cycle per minute universal blank shaft are 1.38" from the butt end portion and 2.62" from the tip end portion.

Charts similar to FIG. 1 are available for each shaft length desired usually including the irons numbering two through nine and pitching wedge as well as the woods numbering one through at least three and up to five. As can readily be understood, several groups of universal blank shafts are the only shafts required in the production of any shaft length and an infinite number of natural frequencies or flex. The universal blank shafts are manufactured so that they fall within a specified frequency range and the individual shafts are then tailored from the blank shaft to produce a shaft of desired length and frequency.

What is claimed is:

1. A method of producing a golf club shaft of predetermined natural frequency and length from an oversized universal blank shaft of given length having tip and butt end portions and a natural frequency within a given range, the method including the steps of measuring the actual natural frequency of the blank shaft, determining relative amounts of material to be removed from the tip and butt end portions of the blank shaft to obtain the desired length and natural frequency of the shaft being produced, removing the relative amounts of shaft material so determined from both the tip and butt end portions of blank shaft, the total amount of material removed from the blank solely depending upon the length of the shaft desired, and the relative amounts removed from the tip and butt end portions of the blank solely depending upon the natural frequency of the shaft desired.

2. A method as in claim 1 including the steps of providing a series of golf club shafts of varying natural frequency and length for the irons numbering 2 through 9 and pitching wedge.

3. A method as in claim 1 including the steps of producing a series of golf club shafts of varying natural frequency and length for the woods numbering 1 through at least 4.

4. A method as in claim 1 including the steps of producing a series of golf club shafts of varying natural frequency and length comprising a set of at least eight shafts.

5. A method as in claim 1 wherein the step of measuring the actual natural frequency of the blank shaft includes securing the butt end portion thereof in place at a stationary location, fastening a predetermined test weight at the tip end portion of the blank shaft, exciting the blank shaft, and measuring the frequency of the oscillations produced thereby.

6. A method as in claim 1 wherein the given range of natural frequency of each universal blank shaft is within the range of approximately 260 through 284 cycles per minute when measured with a test weight of about 285 grams fastened to the tip end portion of the blank.

7. A method as in claim 1 wherein the step of removing the relative amounts of shaft length from the blank shaft is accomplished by cutting those amounts away from the shaft.

* * * * *